United States Patent [19]

Kaji

[11] 4,363,275

[45] Dec. 14, 1982

[54] CONVEYOR SYSTEM AND VEHICLE FOR USE THEREIN

[75] Inventor: Kazusuke Kaji, Kawasaki, Japan

[73] Assignee: SI Handling Systems, Inc., Easton, Pa.

[21] Appl. No.: 215,581

[22] Filed: Dec. 11, 1980

[30] Foreign Application Priority Data

Dec. 18, 1979 [JP] Japan ..... 54-165100

[51] Int. Cl.[3] ..... B61B 13/12

[52] U.S. Cl. ..... 104/166; 104/49

[58] Field of Search ..... 104/35, 49, 50, 130, 104/165, 166, 247; 198/722

[56] References Cited

U.S. PATENT DOCUMENTS

| | | | |
|---|---|---|---|
| 3,361,079 | 1/1968 | Eliassen | 104/88 |
| 3,818,837 | 6/1974 | Jacoby et al. | 104/166 |
| 4,074,632 | 2/1978 | Kurahasi et al. | 104/130 |

FOREIGN PATENT DOCUMENTS

| | | | |
|---|---|---|---|
| 2308532 | 11/1976 | France | 104/166 |
| 167009 | 4/1934 | Switzerland | 104/247 |

*Primary Examiner*—Randolph Reese

*Attorney, Agent, or Firm*—Seidel, Gonda, Goldhammer & Panitch

[57] ABSTRACT

A driverless vehicle is supported by wheels adapted to ride on a floor whereby the conveyor system does not include rails for supporting the vehicle. Guide rollers are provided on one side of the vehicle for contact with a guide on a floor mounted frame. The frame includes a drive shaft for driving a drive wheel on the vehicle. The drive wheel can oscillate about a generally horizontal axis between a drive position and an accumulation position. The floor supported frame includes pivotally mounted sections so that the vehicle can traverse 90° angles.

6 Claims, 18 Drawing Figures

CONVEYOR SYSTEM AND VEHICLE FOR USE THEREIN

BACKGROUND

It is conventional in the subject art to provide driverless vehicles with support wheels therebelow which are adapted to ride on tracks. In large systems, substantial savings can be attained by eliminating the tracks. The present invention accomplishes that goal while retaining drive shafts and redesigning the drive wheel on the vehicle for contact with the drive shaft in a unique manner.

SUMMARY OF THE INVENTION

The driverless vehicle of the present invention includes a horizontally disposed base supported by wheels therebelow which are adapted to ride on a floor. Guide rollers are supported by the base and projecting from one side of the base for contact with a guide. At least one drive wheel is supported by the base adjacent said one side of the base for oscillation about a generally horizontal axis between a drive position and an accumulation position. A means is provided on the base for selectively moving the drive wheel generally horizontally between an operative position wherein it can contact a drive shaft which will be disposed alongside the base and an inoperative position wherein it is out of contact with a drive shaft.

The conveyor system in accordance with the present invention is designed to accommodate the driverless vehicle described above. The system includes a floor mounted frame for supporting drive shafts and a vehicle guide plate. Portions of the frame are mounted for pivotal movement through an arc of approximately 90° to facilitate right angle turns by the vehicle. The support wheels for the vehicle are preferably swivel casters.

It is an object of the present invention to provide a driverless vehicle and associated conveyor system wherein the vehicle rides on a floor instead of tracks.

Other objects and advantages will appear hereinafter.

For the purpose of illustrating the invention, there is shown in the drawings a form which is presently preferred, it being understood, however, that this invention is not limited to the precise arrangements and instrumentalities shown.

DETAILED DESCRIPTION — PRIOR ART

Figure 1:
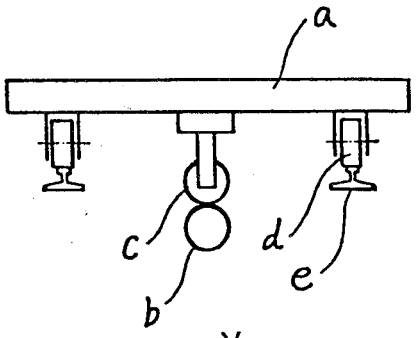
FIG. 1 (PRIOR ART)
FIG. 1 is an end view of a conventional prior art vehicle mounted on tracks.

Referring to FIG. 1, there is shown a conventional driverless vehicle of the type involved herein wherein a base (a) is provided with support wheels (d) which ride on tracks (e). Between the tracks (e), there is provided a drive shaft (b) driven so as to rotate about its longitudinal axis. On the bottom surface of the base (a), there is provided a drive wheel (c) frictionally in contact with the drive shaft (b). The drive wheel (c) is oscillatable about a vertical axis between a drive position and an accumulation position and is spring biased into contact with the drive shaft (b).

If it is desired to avoid providing a trench in the floor for receiving the drive shaft (b), a subframe must be mounted on the floor to elevate the tracks (e) whereby both the tracks and the drive shaft are above floor level. If the conveyor system is of substantial length such as 500 meters, a substantial amount of metal and construction is needed in order to provide and support the rails (e).

DETAILED DESCRIPTION — PRESENT INVENTION

Figure 2:
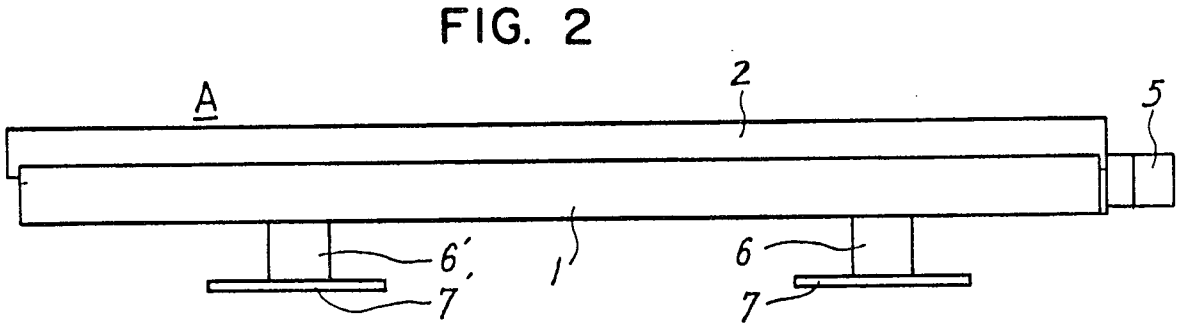
FIG. 2 is a side elevation view of a frame section in accordance with the system of the present invention.
Figure 3:
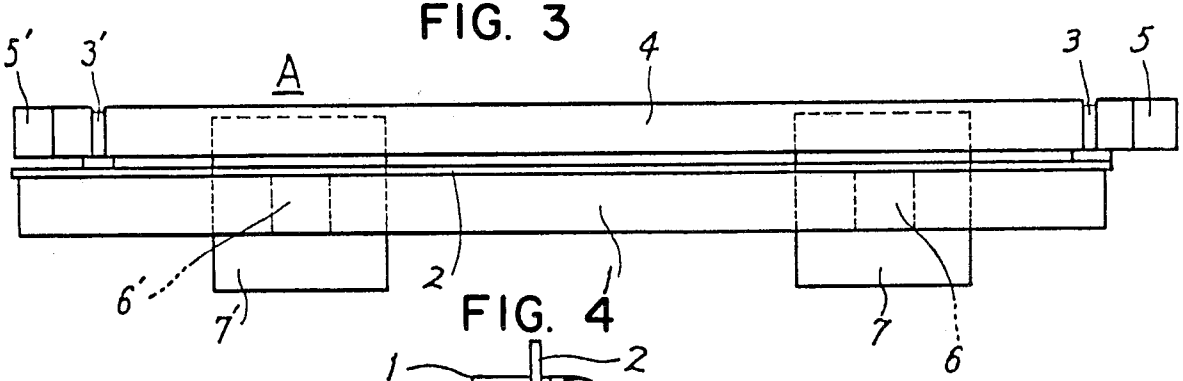
FIG. 3 is a top plan view of the frame section shown in FIG. 2.
Figure 4:
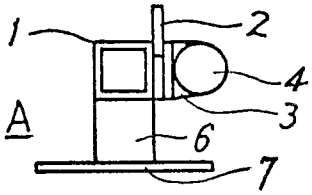
FIG. 4 is an end view of the frame section shown in FIG. 2.

Referring to the drawings in detail, wherein like numerals indicate like elements, there is shown in FIG. 2 a frame section of the conveyor system and designated A. Frame section A includes a vertically disposed guide surface such as guide plate 2 supported by the frame 1. At spaced points along the frame section A, there is provided a pair of legs 6 connected at their lower end to floor engaging bed plates 7, 7'. Brackets 3 are attached to the frame 1 at spaced points therealong and include bearings for supporting a section of drive shaft 4. The drive shaft section 4 is provided with coupling elements 5, 5' on opposite ends for connecting one drive shaft section 4 to another. Thus, one section A may be coupled to another section which is identical therewith or compatible therewith.

Figure 5:
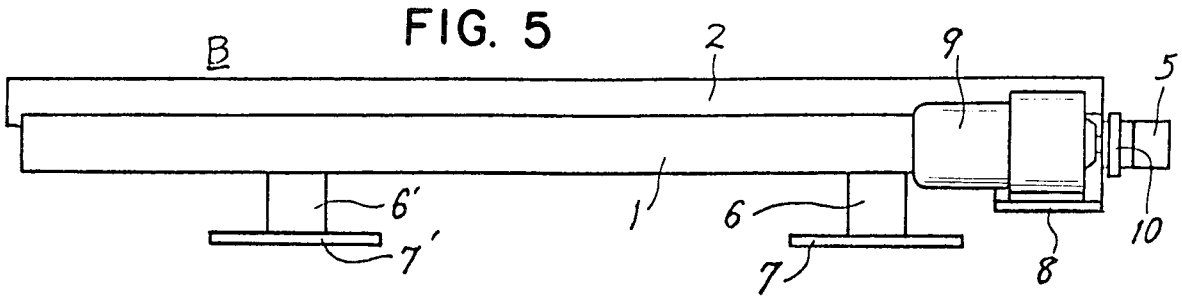
FIG. 5 is a side elevation view of a frame drive section forming part of the conveyor system.
Figure 6:
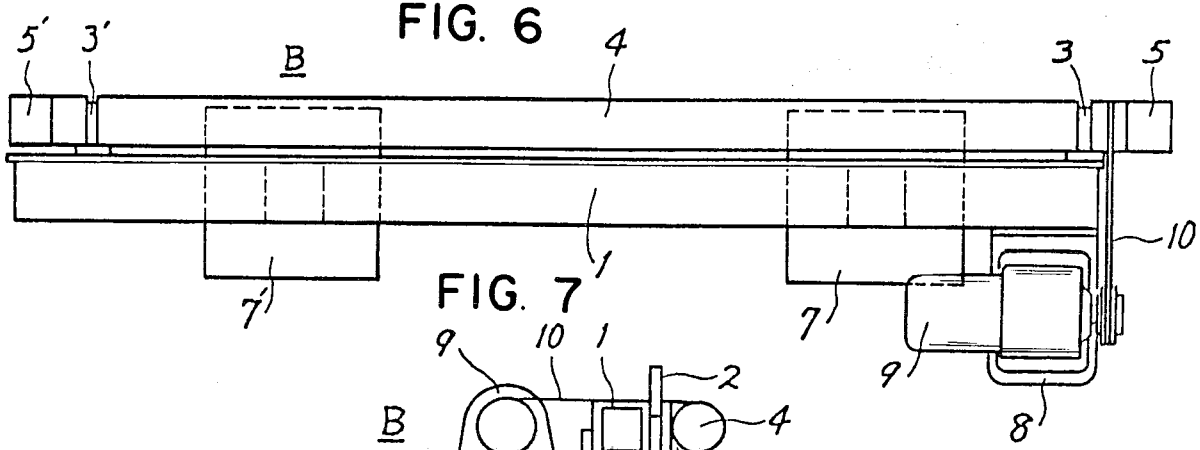
FIG. 6 is a top plan view of the frame section shown in FIG. 5.
Figure 7:
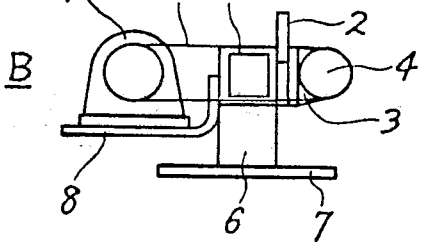
FIG. 7 is an end view of the frame section shown in FIG. 5.
Figure 8:
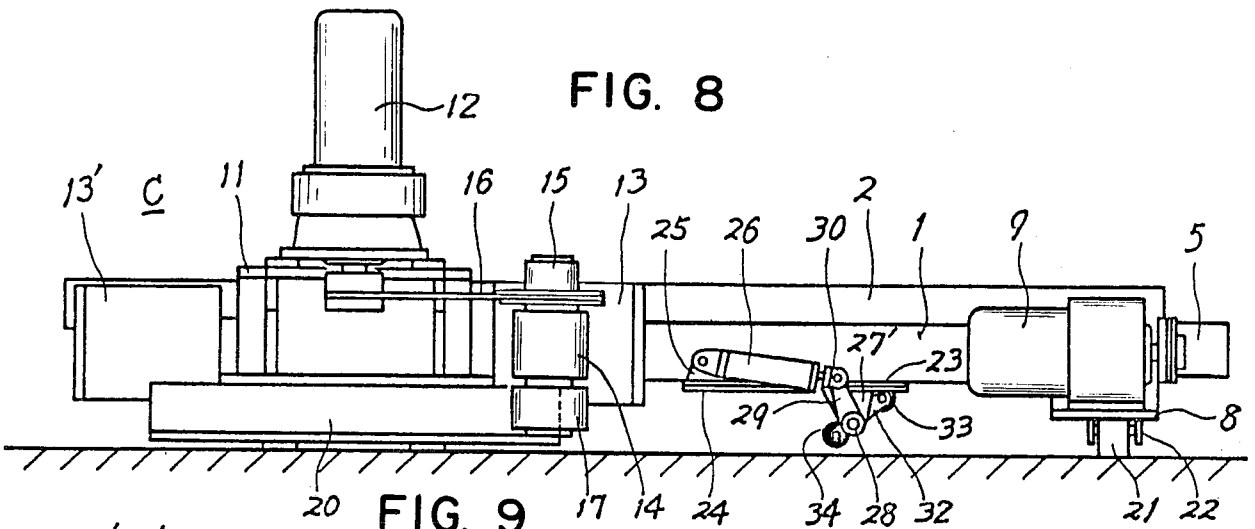
FIG. 8 is a side elevation view of a frame turning section forming part of the conveyor system.

In FIGS. 5–7, there is illustrated another frame section designated B. Section B may be coupled to section A and includes corresponding elements except as will be made clear hereinafter. As shown, section B includes a bracket 8 attached to one of the vertical legs 6. Bracket 8 supports a motor 9 which drives the shaft section 4 by way of a belt 10. Thus, rotation of a shaft section 4 on section B will drive corresponding shaft sections on the adjacent frame sections. Section B is otherwise identical to section A.

As shown more clearly in FIGS. 8–11, there is illustrated another frame section designated C. Frame section C is a turning section in that it may oscillate through an arc of 90° from a position aligned with section A or B to a position where it is 90° with respect to section A or B.

Section C is identical with section B except as will be made clear hereinafter. Section C includes a mounting plate 11 on which is supported a motor 12. Base plates 13, 13' are attached to a side face of the frame 1. A bracket 14 extends horizontally from the base plate 13 and supports a vertically disposed shaft 15. A pulley attached to shaft 15 is coupled to the output pulley of motor 12 by way of belt 16.

Figure 9:
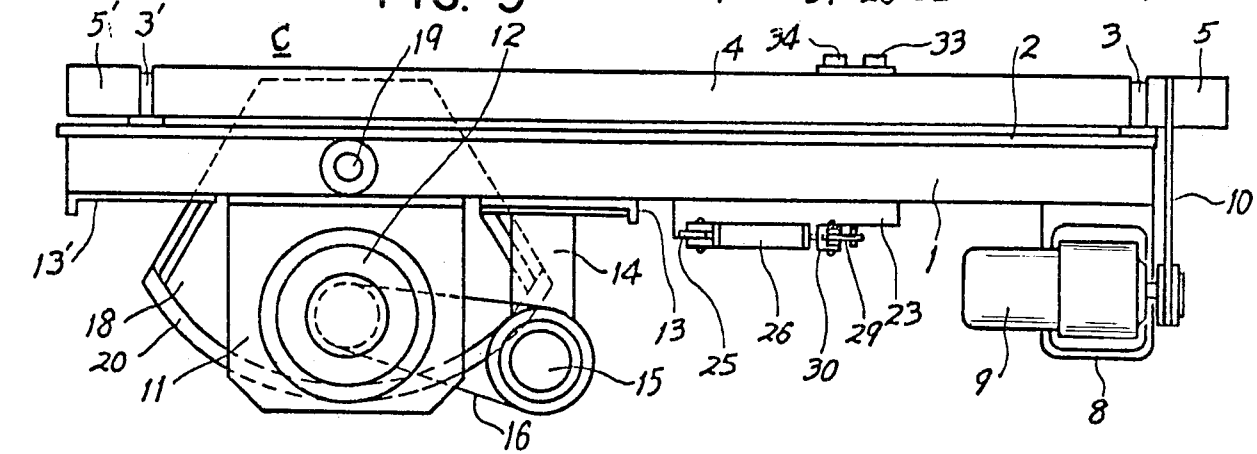
FIG. 9 is a top plan view of the frame section shown in FIG. 8.
Figure 10:
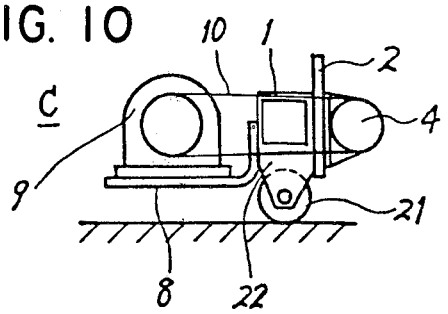
FIG. 10 is an end view of the frame section shown in FIG. 8.
Figure 11:
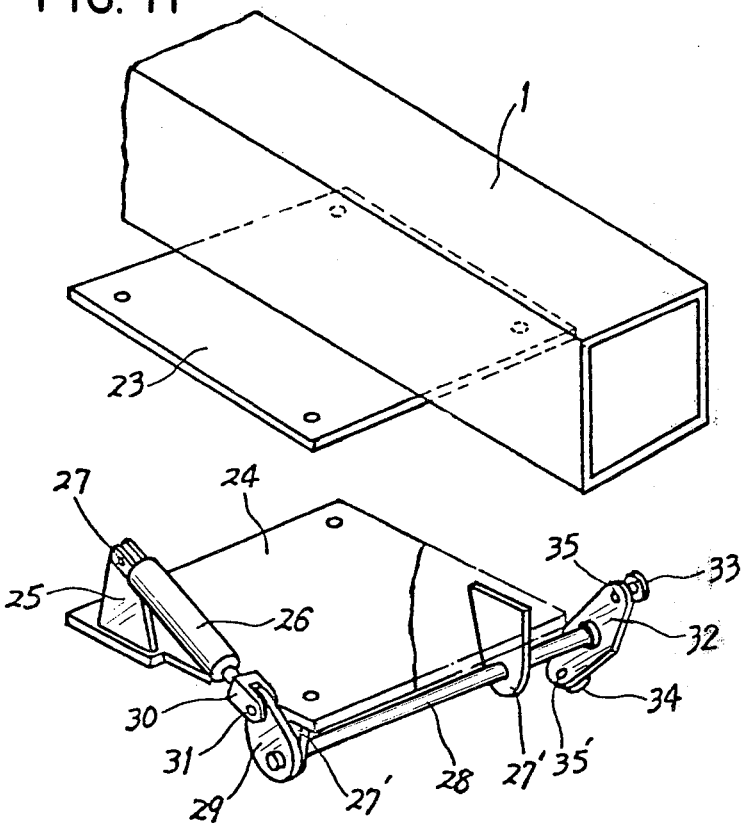
FIG. 11 is a partial perspective view illustrating the speed control components forming part of the frame section shown in FIG. 8.
Figure 12:
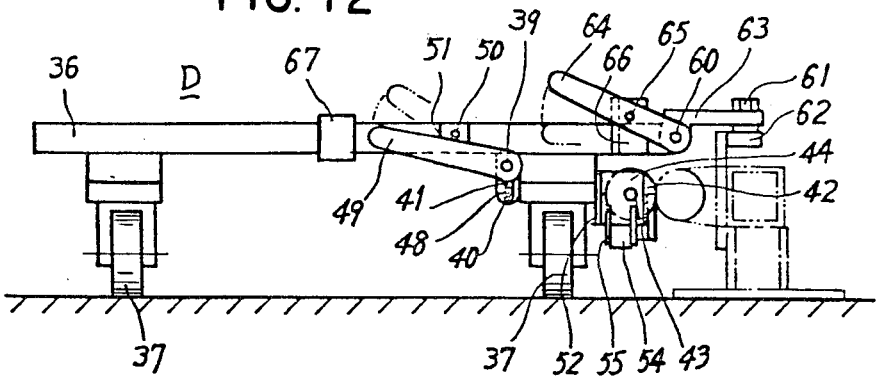
FIG. 12 is a front end view of a vehicle used in the system of the present invention.
Figure 13:
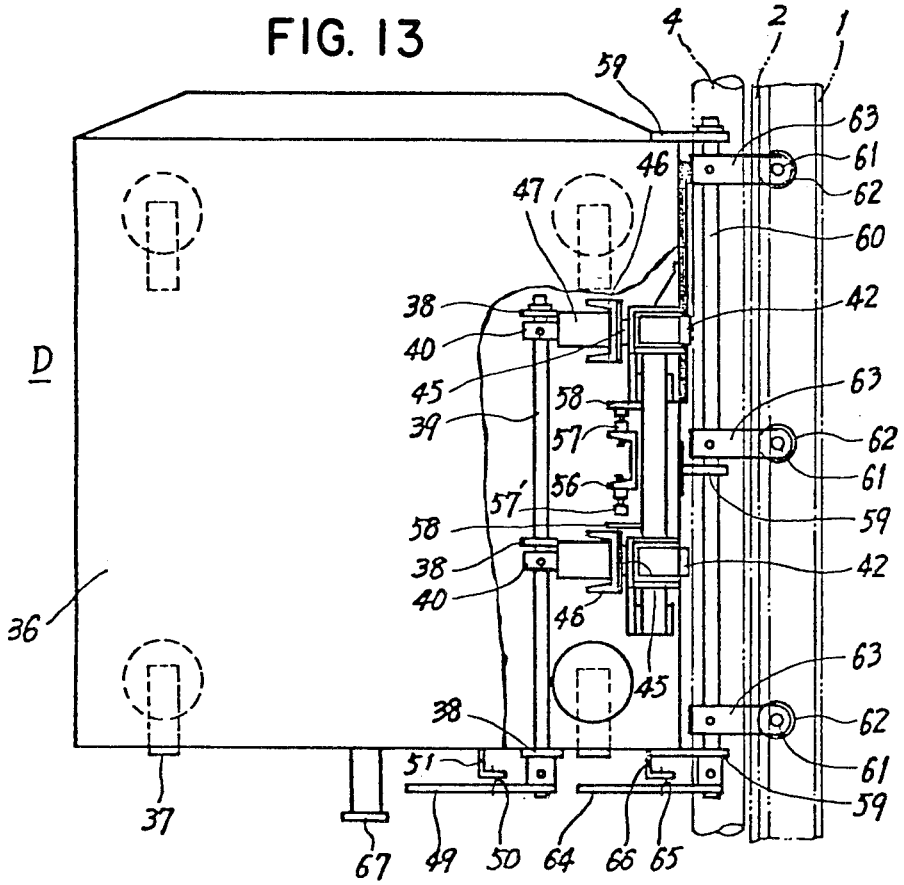
FIG. 13 is a top plan view of the vehicle shown in FIG. 12.

A stationary base plate 18 is fixedly secured to the floor below the frame 1. Plate 18 is pivotably supports the frame 1 for oscillation about a vertical shaft 19. Plate 18 includes a guide surface 20 which is arcuate as shown in FIG. 9. A guide roller 17 is attached to the shaft 15 and is in rolling contact with the guide surface 20. An auxiliary wheel 21 for the section C is attached to the plate 8 by way of bracket 22 so that section C can oscillate about the vertical axis of shaft 19.

The frame section C is provided with a device for causing a driverless vehicle to stop or accumulate while on the section C. Such device is shown more clearly in FIG. 11. A base plate 23 is secured to a bottom surface on the frame 1. A mounting plate 24 is bolted to the base plate 23. Plate 24 supports a cylinder 26 having one end pivotably coupled to a bracket 25 by way of a pin 27. A piston rod associated with cylinder 26 has its free end connected to a clevis 30. Clevis 30 is connected by pivot pin 31 to a lever 29. Lever 29 is fixedly secured to a rod 28. Rod 28 is rotatably supported by brackets 27' depending from the plate 24.

A lever 32 is fixedly secured intermediate its ends to the rod 28. At one end of lever 32, there is provided a cam followr 33 which rotates about pin 35. At the other end of the lever 32, there is provided a cam follower 34 which rotates about the pin 35'. As shown more clearly in FIG. 9, cylinder 26 is on one side of the frame section C while the cam followers 33, 34 are on the opposite side.

Referring to FIGS. 12–15, there is illustrated a driverless vehicle designated generally D. Vehicle D includes a horizontally disposed platform or base 36 provided with support wheels 37 which ride on the floor. Wheels 37 are preferably caster wheels so that they may swivel. The vehicle D is illustrated alongside a conveyor track section such as track section A which is shown in phantom in FIGS. 12 and 13.

The vehicle D, below the base 36, is provided with a longitudinally extending rod 39 supported at its ends by brackets 38. Vehicle D is provided with a pair of drive wheels each designated 42 and associated with the shaft 39. Only the structure with respect to one such drive wheel will be described in detail. A clevis 40 is attached to the shaft 39. See FIGS. 13 and 15. The arms of the clevis 40 have an elongated hole 41 therein.

The drive wheel 42 rotates about the axle 43 supported by the yoke or bracket 44. Yoke 44 may oscillate about a substantially horizontal axis and is provided with a generally horizontally disposed support shaft 45. Shaft 45 extends through a hole in bracket 46 supported at its upper end by a lower surface of the base 36. A device 47, preferably including a torsion spring, biases the drive wheel 42 into contact with a drive shaft 4 and has one end pivotably connected to the clevis 41 by way of pin 48. A handle 49 is fixedly connected at one end of the shaft 39 and is disposed forwardly of the front edge of the base 36 as shown more clearly in FIG. 13. Handle 49 facilitates selective reciprocation of the drive wheel 42 toward and away from the drive shaft 14. Thus, drive wheel 42 is moved away the drive shaft 4 when the handle 44 is manually pivoted to the phantom position shown in FIG. 12.

A bracket 56 depends from the lower surface of the base 36 at a location between the drive wheels 42. The bracket 56 is preferably a channel shape with each leg thereof being provided with one of the limit stops 57, 57'. Each limit stop is adapted to engage one of the vertically disposed projections 58. See FIG. 13.

A control bar 54 having projection 58 thereon is supported by a pair of spaced members 55. See FIG. 15. The control bar 54 has a cam surface which may be actuated by the cam followers 33, 34 to oscillate the drive wheels 42 between a drive position and an accumulation position. Each of the brackets 44 is pivotably connected to one of the support members 55 by way of a discrete lever 52 pivotably connected to member 55 by pin 53. Thus, control bar 54 is connected to the drive wheels by a parallelogram linkage.

Brackets 59 rotatably support the end portions of a rod 60 adjacent the upper surface of the base 36. See FIGS. 12 and 13. Brackets 63 are fixedly secured to rod 60 at spaced points therealong. Each bracket 63 supports a guide roller 62 attached to shaft 61. Each shaft 61 is connected to one end of one of the bracket 63. Guide rollers 62 contact the guide plate 2 and prevent the vehicle 10 from moving away from the frame which would have the effect of inadvertently interrupting contact between the drive wheels 42 and the drive shaft 4.

A lever 64 has one end fixedly secured to the rod 60. Lever 64 is pivoted by way of pin 65 intermediate its ends to the bracket 66 at the front end of the vehicle D. Lever 64 is manually adjustable from the solid line position shown in FIG. 12 to the phantom position shown therein. In the phantom position of the lever 64, the guide rollers 62 lose contact with the guide plate 2 and move outwardly away from the guide plate. Vehicle D is preferably provided with a bumper 67 of any suitable design on its front end. Bumper 67 prevents contact between vehicles D which may have the tendency to bend or otherwise damage the handles 49, 64.

Figure 16:
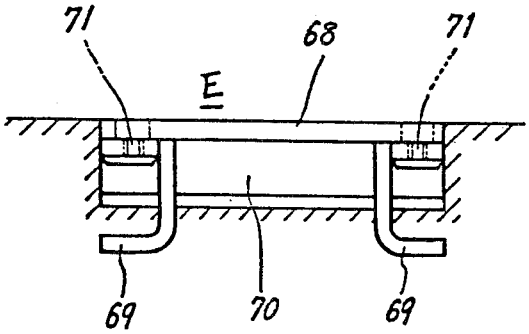
FIG. 16 is a section view of the floor showing an end view of a metal foundation used in the conveyor system.
Figure 17:
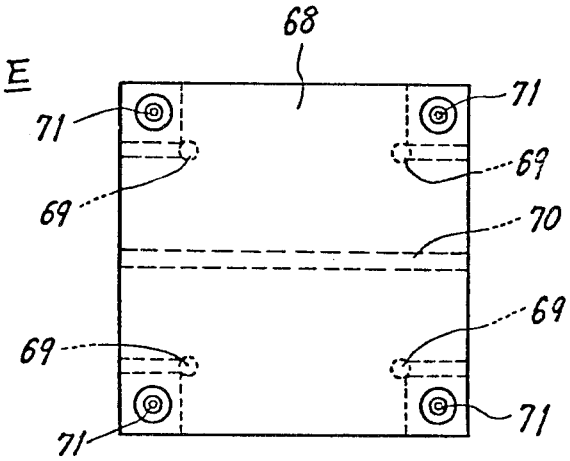
FIG. 17 is a top plan view of the foundation shown in FIG. 16.

As shown more clearly in FIGS. 16 and 17, there is provided metal foundations E in the floor. The foundations E include a flat base plate 68 provided with a plurality of anchor members 69 which are L-shaped. Plate 68 is provided with a transverse reinforcing plate 70. The foundation is mounted within a recess in the floor so as to be flush therewith. A hole 71 is provided in each corner of the plate 68 to facilitate bolting the bed plates 7, 7' to the floor. The plates 68 are arranged in a pattern on the floor in a manner so as to correspond to the desired pattern for the conveying system.

Figure 18:
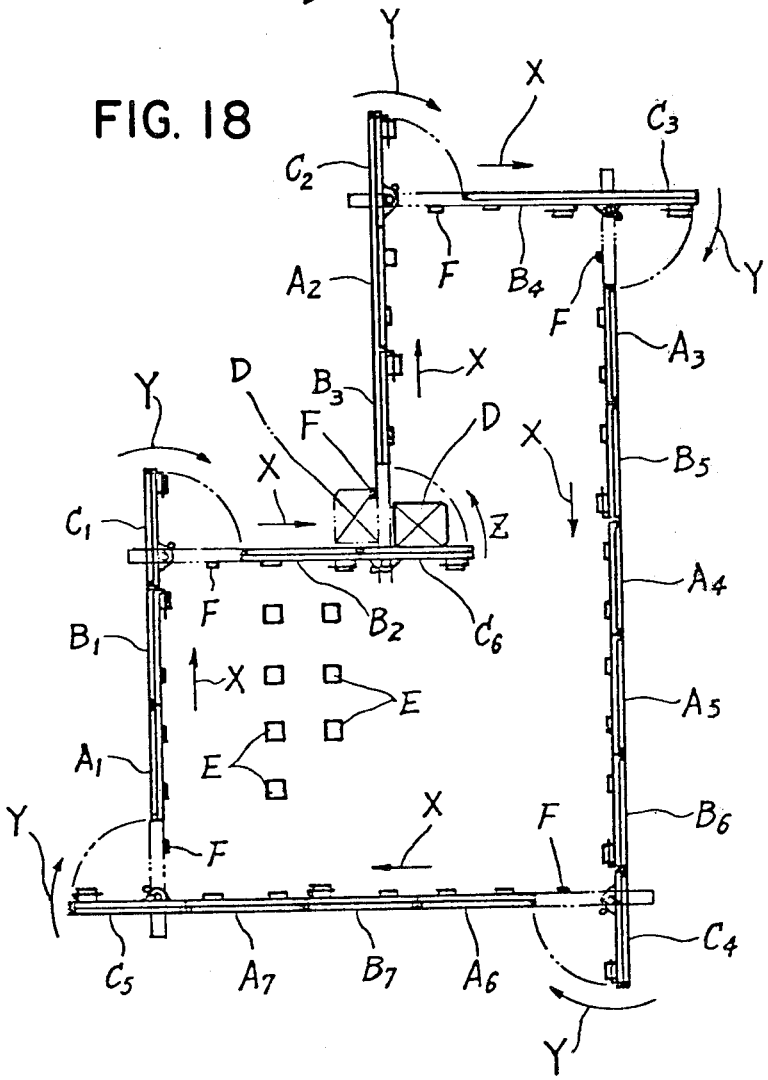
FIG. 18 is a diagrammatic layout of one conveyor system in accordance with the present invention.

In FIG. 18, there is diagrammatically illustrated a plan view of a conveyor system in accordance with the present invention. The system may assume a wide variety of shapes. Each leg of the system is comprised of one or more of the sections A, B, C. As illustrated, there are seven straight sections of type A, seven driving sections of type B, and six turning sections of type C. A turning section C is provided at each location where it is desired to cause the vehicle D to make a 90° turn. In FIG. 18, the vehicles D move on the outside of the frame in the direction X. All turning sections C are adapted to oscillate in a clockwise direction indicated by arrow Y except for section C-6 which oscillates in a counterclockwise direction indicated by the arrow Z.

Figure 14:
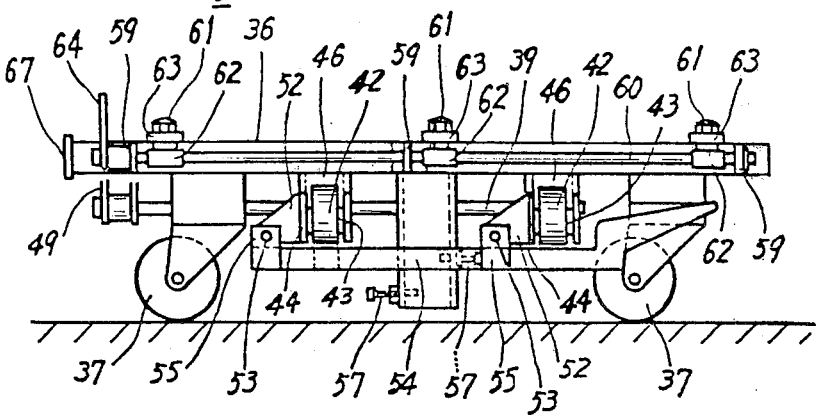
FIG. 14 is a side elevation view of the vehicle.
Figure 15:
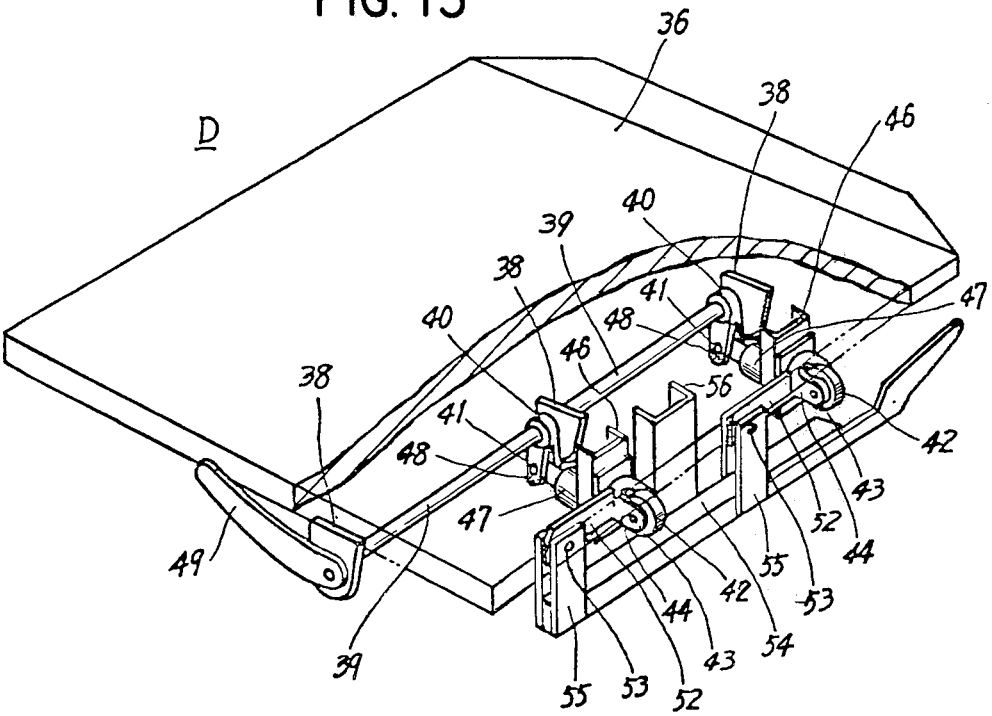
FIG. 15 is a partial perspective view of a portion of the vehicle with the base being broken away for purposes of illustration.

Each leg of the conveyor system includes at least one driving section B. The vehicle 10 is propelled along a leg of the conveyor system while its support wheels 37 are on the ground. The drive wheels 44 are driven by frictional contact with the drive shafts 4. When the vehicle D arrives onto one of the turning sections C, it trips a microswitch to cause motor 12 to start rotating the section C about the axis of shaft 19 due to the driving effect between follower 17 and the surface 20. Immediately thereafter, the cam follower 33 contacts and elevates the control bar 54 to thereby rotate the drive wheels 42 to an accumulation position as illustrated in FIGS. 14 and 15. The extent of movement of control bar 54 is controlled by contact between limit stops 57, 57' and projections 58. Vehicle D is now stationary on the turning section C.

After the turning section C is rotated through an arc of 90°, a microswitch is tripped to activate cylinder 26. When cylinder 26 is activated, it rotates rod 28 to thereby rotate lever 32 to a position wherein control bar 44 may descend due to gravity and due to the fact that the devices 47 include a torsion spring which biases the drive wheels 42 to a drive position. The vehicle now transfers onto the next frame section. When that occurs, a microswitch is tripped to reverse motor 12 and return the turning section C to its previous vehicle receiving position.

The present invention may be embodied in other specific forms without departing from the spirit or essential attributes thereof and, accordingly, reference should be made to the appended claims, rather than to the foregoing specification, as indicating the scope of the invention.

I claim:

1. A driverless vehicle comprising a horizontally disposed base supported by wheels therebelow which are adapted to ride on a floor, guide rollers supported by the base and projecting from one side of the base for contact with a guide, at least one drive wheel at an elevation above the elevation of the axis of said wheels and being supported by the base adjacent said one side of the base, control means for oscillating said drive wheel about a generally horizontal axis between a drive position and an accumulation position, and means on the base for selectively moving the drive wheel generally horizontally between an operative position wherein it can frictionally contact a rotating drive shaft to be disposed alongside the base and an inoperative position wherein it is out of contact with a drive shaft.

2. A vehicle in accordance with claim 1 including means on the base for moving the guide rollers between operative and inoperative positions.

3. A vehicle in accordance with claim 1 wherein said drive wheel oscillating means includes a control bar supported by the base at an elevation below the elevation of the drive wheel and mounted for swinging movement by way of a parallelogram linkage extending upwardly therefrom, and limit stops on the base for controlling the extent of movement of said control bar.

4. A vehicle in accordance with claim 1 including a pair of drive wheels on said base alongside one another, each drive wheel being coupled to said control means, each drive wheel being coupled to said selective moving means.

5. A conveyor system including a vehicle in accordance with claim 1, said system including a plurality of aligned drive shafts for driving said drive wheel, one of said shafts being supported by a frame section oscillatable through an arc of 90° about a vertical axis, and means on said last-mentioned section for selectively actuating said control means on the base, said vehicle support wheels being caster wheels so that the vehicle may oscillate with the last-mentioned frame section.

6. A conveyor system comprising a plurality of aligned drive shafts, frame sections supporting said shafts at an elevation above a floor, one of said shafts being supported by a frame section oscillatable through an arc of 90° about a vertical axis for alignment with each of two mutually perpendicular frame sections, a driverless vehicle having a horizontally disposed base supported by wheels therebelow which ride on said floor, guide rollers supported by the base and projecting from one side of the base for contact with a guide supported by said frame sections, at least one drive wheel at an elevation above the elevation of the axis of said support wheels, said drive wheel being supported by the base adjacent said one side of the base, control means for oscillating said drive wheel about a generally horizontal axis between a drive position and an accumulation position, means on the base for selectively moving the drive wheel generally horizontally at said elevation between an operative position wherein it can frictionally contact said drive shaft and an inoperative position wherein it is out of contact with said drive shafts, means on said oscillatable frame section for selectively actuating said control means on the base to cause a vehicle moving therealong to accumulate, and said vehicle support wheels being caster wheels so that the vehicle may oscillate with the last-mentioned frame section.

* * * * *